US005142954A

United States Patent [19]

Starke

[11] Patent Number: 5,142,954

[45] Date of Patent: Sep. 1, 1992

[54] MASONRY ANCHOR INSTALLATION TOOL

[75] Inventor: David E. Starke, Whitfield, Pa.

[73] Assignee: Emhart, Inc., Newark, Del.

[21] Appl. No.: 708,446

[22] Filed: May 31, 1991

[51] Int. Cl.[5] ..... B25B 23/00

[52] U.S. Cl. ..... 81/429; 81/121.1; 81/54

[58] Field of Search ..... 81/121.1, 180.1, 429, 81/54

[56] References Cited

U.S. PATENT DOCUMENTS 4,030,383 6/1977 Wagner ..... 81/180.1 X 4,107,800 8/1978 Jorgensen ..... 81/429 X 5,012,708 5/1991 Martindell ..... 81/429

*Primary Examiner*—James G. Smith

*Attorney, Agent, or Firm*—Spencer T. Smith

[57] ABSTRACT

A hole drill/fastener driving tool has a drive tube and a nut driver. A declutching sleeve which is intended to remain stationary during fastener driving receives the nut driver with the hex end of the nut driver passing through the closed end of the sleeve into the drive tube. A spacing is defined between the front of the nut driver and sleeve for declutching the nut driver when the screw is set.

2 Claims, 2 Drawing Sheets

MASONRY ANCHOR INSTALLATION TOOL

The present invention relates to installation tools which are to be used to install masonry anchors.

One of the inherent problems with masonry anchors is that breakage can occur when the head section of the screw is bottomed out or seated against the fixture being attached. A prior art solution disclosed in U.S. Pat. No. 3,965,510 incorporates a declutching feature in the installation tool to cause the socket to declutch off the head of the screw when the screw reaches the recommended depth or embedment. This reduces the chance of breakage but in certain applications the declutching feature restricts or does not allow for proper seating of the screw head and marring of the surface can occur.

An object of this invention is to provide a device which enables the end user to install a masonry anchor device with minimum effort.

Another object of this invention is to provide a means of reducing any breakage which can occur during seating of the screw head of a masonry anchor.

A further another object of this invention is to provide a means of reducing the amount of marring or scratching occurring during installation.

Still another object of this invention is to provide a means of insuring full seating of the screw.

Other objects and advantages of the present present invention will become apparent from the following portion of this specification and from the accompanying drawings which illustrates in accordance with the mandate of the patent statutes a presently preferred embodiment incorporating the principles of the invention.

Referring to the drawings:

FIG. 1 an exploded partial view of a drive tube assembly which accepts a nut driver and declutching sleeve is made in accordance with the teachings of the prior art.

Figure 1:
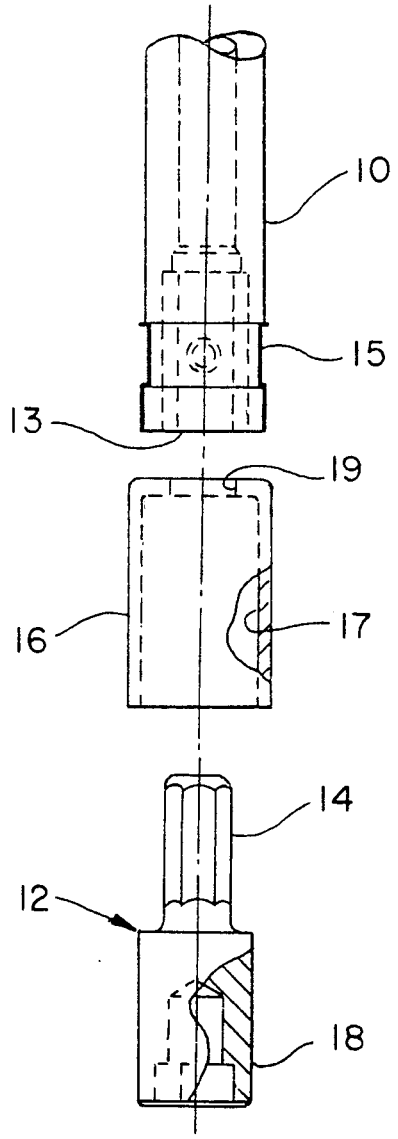
Figure 2:
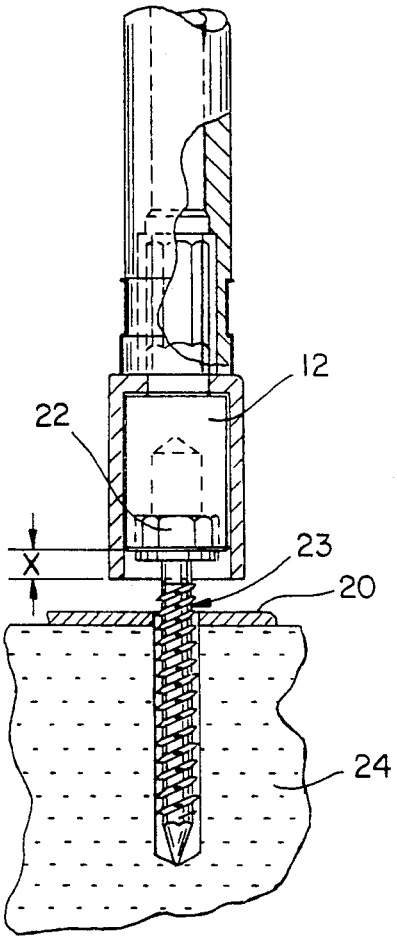
FIG. 2 is an elevational view of screw being driven downward into the base material.
Figure 3:
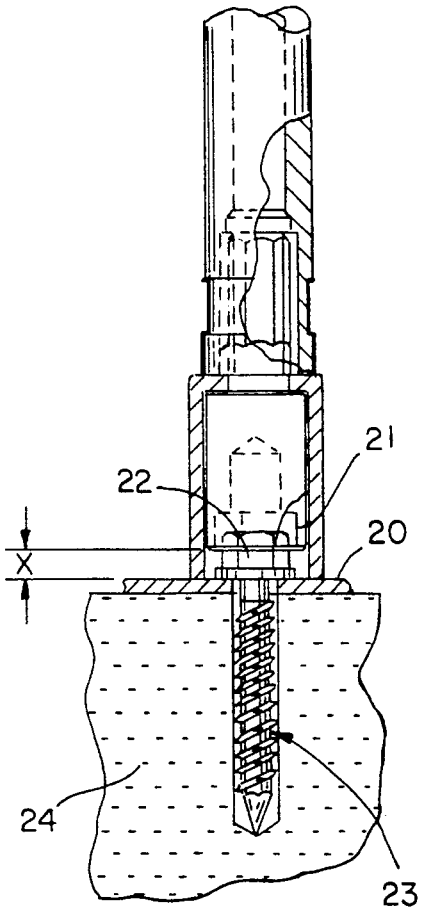
FIG. 3 is a similar view with the hex head portion of the screw being bottomed out or seated against the fixture.

The hole drill/fastener driving tool assembly is comprised of a drive tube 10 and a nut driver 12 which is inserted into the hex 13 end of the drive tube. A special hex configuration 14 on the rear portion of the nut driver 12 is inserted into the hex hole 13 in the drive tube 10. As the nut driver 12 is pushed inward, the hex portion 14 engages a spring collar 15 which holds the nut driver in position. This assembly is connected to a hammer drill using a special adaptor not shown. A declutching sleeve 16 is secured between the drive tube 10 and the nut driver 12. This declutching sleeve 16 has a cylindrical inner surface 17 which receives the cylindrical portion 18 of the cylindrical nut driver 12. The hole 19 in the closed end of the declutching sleeve 16 is larger than the hex end 14 of the nut driver so that the declutching sleeve will remain stationary as the nut driver is rotated. This will prevent the marring of the surface of the fixture 20. The nut driver 12 has an internal hex configuration 21 at the free end for placement over the head 22 of a hex head screw 23 which is used for driving the screw.

The hex head 22 on the screw 23 is driven downward by the nut driver 12 of the tool assembly which is fully engaged onto the hex head of the screw 23.

At the point when the hex head 22 portion of the screw 23 becomes bottomed out or seated against the fixture 20 being attached, the internal hex 21 of the nut driver 12 can no longer completely grip the hex portion of the screw. This is a result of the relationship between spacing of the front surfaces of the nut driver 12 and declutching sleeve 16 which at some point changes the depth of engagement between the hex configuration 21 of the nut driver 12 and the hex configuration 22 on the head of the screw. This spacing which is designated (x) and is held constant, causes the nut driver 12 to spin off or disengage the screw head 22 when the screw is fully seated thus discontinuing the driving of the screw into the base material 24.

The declutching sleeve 16 is removable and can be eliminated from the tool assembly by removing the nut driver 12 from the drive tube 10. The nut driver 12 can be used without the declutching sleeve 16 attached in applications where it is not necessary.

I claim:

1. A masonry screw installation tool comprising a drive tube having a hex bore extending axially into one end, a nut driver having a hex portion at one end to be received by said hex bore, and a cylindrical portion at the other end having a screw head receiving opening, and a cylindrical declutching sleeve closed at one end and open at the other end for slidably receiving said nut driver cylindrical portion, an axial through hole extending through said closed end so that said cylindrical portion can be fully inserted into said cylindrical bore with said hex portion passing through said axial through hole into said drive tube hex bore to removably secure said declutching sleeve between said drive tube and said nut drive, said axial through hole being selectively sized so that said nut driver can rotate while said declutching sleeve is stationary whereby when said declutching sleeve engages the surface into which the masonry screw is being installed, said declutching sleeve will remain stationary as said nut driver rotates, and said declutching sleeve having an axial length selected so that a predetermined spacing will be defined between the open end of said declutching sleeve and the end of said nut driver when said nut driver and declutching sleeve are secured to said drive tube.

2. A masonry installation tool according to claim 1 wherein said screw head receiving opening is hex shaped.

* * * * *